US005226393A

United States Patent [19]

Nagano et al.

[11] Patent Number: 5,226,393

[45] Date of Patent: Jul. 13, 1993

[54] ALTITUDE DECISION SYSTEM AND AN ENGINE OPERATING PARAMETER CONTROL SYSTEM USING THE SAME

[75] Inventors: Masami Nagano; Takeshi Atago; Masahide Sakamoto, all of Katsuta, Japan

[73] Assignee: Hitachi, Ltd., Tokyo, Japan

[21] Appl. No.: 840,940

[22] Filed: Feb. 25, 1992

[30] Foreign Application Priority Data

Feb. 28, 1991 [JP] Japan ..... 3-34032

[51] Int. Cl.[5] ..... F02D 41/04

[52] U.S. Cl. ..... 123/478; 123/494

[58] Field of Search ..... 123/416, 417, 478, 480, 123/486, 339, 494

[56] References Cited

U.S. PATENT DOCUMENTS 4,212,065 7/1980 Marchak et al. ..... 123/486
4,495,921 1/1985 Sawamoto ..... 123/480
4,582,031 4/1986 Janetzke et al. ..... 123/339
4,803,966 2/1989 Denz ..... 123/478
4,864,998 9/1989 Onishi ..... 123/494
4,907,556 3/1990 Ishii et al. ..... 123/486
4,926,335 5/1990 Flowers et al. ..... 123/494
4,941,448 7/1990 Nakaniwa et al. ..... 123/480

*Primary Examiner*—Willis R. Wolfe
*Attorney, Agent, or Firm*—Ladas & Parry

[57] ABSTRACT

An altitude decision system and engine operating parameter control system using the same for accurately detecting and correcting for altitude uses three signals, viz, the signal from an engine revolution number sensor, the signal from a throttle sensor for detecting the angle of opening of a throttle valve, and a fundamental fuel injection pulse width signal which is computed by engine operational parameter-computer from inputted signals from a mass air flow sensor and the revolution number detection sensor. Having accurately derived the altitude, the fuel injection pulse rate, the intake air flow and the ignition timing are corrected.

10 Claims, 10 Drawing Sheets

ALTITUDE DECISION SYSTEM AND AN ENGINE OPERATING PARAMETER CONTROL SYSTEM USING THE SAME

BACKGROUND OF THE INVENTION

1. Field of the Invention

The present invention relates to an altitude decision system for an internal combustion engine and to an engine operating parameter control system using the altitude decision system. In particular, the invention is useful for a system capable of achieving a fuel injection rate, an intake air flow and ignition timing which is optimized for the altitude of the engine.

2. Description of the related art

In the prior art, as disclosed in Japanese Patent Laid-Open No. 8339/1989, there is prepared an altitude map, in which an altitude corresponding to an intake air flow ($Q_a$) for both a predetermined angle of opening of a throttle valve and a predetermined number of revolutions of the engine is predetermined and stored in the form of a map in a memory. The altitude is determined from the aforementioned memory map using the intake air flow (which is measured by an air flow meter for a predetermined throttle valve opening ($\theta_{TH}$) detected by a throttle sensor) and the predetermined engine number of revolutions ($N_e$) (detected by a revolution number sensor). A plurality of predetermined maps of $\theta_{TH}$ and $N_e$ are required for different intake air flow quantities $Q_a$. To avoid overloading memory storage and to reduce software computations, the number of memory maps is restricted to, say, 100 m increments in height from sea level.

In the system of the forementioned prior art, if a mass air flow sensor is used, the performance in the steady state is not affected even at a high altitude by an over rich air/fuel (A/F) ratio in a partial region of operation unlike the system using a capacity type air flow sensor. If the vehicle goes up to a high altitude with the control constants set for a low altitude, various difficulties occur due to the air density dropping.

In order to start the engine, for example, the startability will be deteriorated due to shortage of the intake air flow unless the open duty of the idle speed control (ISC) valve is made larger than that for low altitude. Unless the fuel injection pulse width at the start is reduced, on the other hand, there arises a problem in that the A/F ratio becomes over rich to deteriorate the startability. For acceleration, moreover, the ability to accelerate will be deteriorated by the rich A/F ratio unless the injection rate is reduced. Unless the ignition timing is retarded, moreover, there will arise another problem in that the engine knocks when the throttle valve is fully opened.

The foregoing problems relate to the engine performance. Furthermore, because of the requirement for an altitude decision map, problems such as an increase in the burden upon the software occur which is also adversely affected with regard to accuracy due to variations in performance of the throttle sensor and the air flow sensor.

An object of the present invention is to provide an altitude decision system for an internal combustion engine and an engine operating parameter control system using the same which is free of any increase in the burden upon the software and which is able, even at a high altitude, to achieve the same performance of the vehicle as at low altitude.

SUMMARY OF THE INVENTION

According to one aspect of this invention there is provided an altitude decision system for an internal combustion engine comprising:

an intake air sensor for detecting the flow of intake air of an engine and providing an output signal indicative thereof; an engine revolution number sensor for detecting the number of revolutions of the engine and providing an output signal indicative thereof; wherein computer means are connected to receive output signals from said intake air flow sensor and said engine revolution sensor and for computing a fundamental fuel injection pulse width signal; a throttle sensor for detecting the angle of opening of a throttle valve and for providing an output signal indicative thereof; and altitude decision means connected to receive the signals from said revolution number sensor, said throttle sensor and said computer means and on the basis thereof determines an altitude from said three signals.

Preferably, there is further provided maximum update means for updating the maximum of the fuel injection pulse width signal within a predetermined altitude decision region which is preset in terms of the engine revolution number and the throttle opening; means for computing the ratio of the prevailing fuel injection pulse width to said maximum; and means for deciding the altitude from said ratio to an altitude representative of the predetermined altitude region.

In a preferred embodiment there is also provided storage means for storing a predetermined fuel injection pulse width parameter ($T_{p1}$) for a predetermined range of throttle valve angle openings ($\theta_{TH}$) at a predetermined altitude, means for measuring a prevailing fuel injection pulse width ($T_p$), and means for calculating the ratio ($T_p/T_{p1}$) of said actual fuel injection pulse width with said predetermined fuel injection pulse width for determining the prevailing altitude.

According to a feature of said one aspect there is provided an intake air flow sensor for detecting the flow of intake air of an engine and providing an output signal indicative thereof; an engine revolution number sensor for detecting the number of revolutions of the engine and providing an output signal indicative thereof; a throttle sensor for detecting the angle of opening of a throttle valve and for providing an output signal indicative thereof; computer means for computing a fundamental fuel injection pulse width from the signals outputted from said air flow sensor and said engine revolution number sensor; altitude decision means connected to receive the signals from said revolution number sensor, said throttle sensor and said computer means for determining an altitude from said three signals; and corrector means connected to receive an output from the altitude decision means for correcting at least one of said fuel injection pulse width, said intake air flow rate, and ignition timing of said engine on the basis of altitude.

Advantageously, said corrector means for correcting fuel injection pulse width is adapted to vary the fuel injection pulse width at a time of acceleration in dependence upon water temperature, change of the throttle angle per unit of time, and the ratio of an actual fuel injection pulse width ($T_p$) with a predetermined fuel injection pulse width ($T_{p1}$) at predetermined altitude.

According to another aspect of this invention there is provided a method of determining an altitude for an internal combustion engine including the steps of detecting the valve intake area of the engine and providing an output signal indicative thereof; detecting the number of revolutions of the engine and providing an output signal indicative thereof; wherein said output signals are applied to a computer means for computing a fuel injection pulse width in dependence upon said applied signals; detecting the angle of opening of a throttle valve and providing an output signal indicative thereof; and applying the signals indicative of the number of engine revolutions, the angle of opening of the throttle valve and the fuel injection pulse width signal to an altitude determining means for determining the altitude from said three signals.

Preferably, the method further comprises the steps of updating the maximum of the fuel injection pulse width signal within a predetermined altitude decision region which is preset in terms of the engine revolution number and the throttle opening, and computing the ratio of the prevailing fuel injection pulse width to said maximum, and deciding the altitude from said ratio to an altitude representative of the predetermined region.

Advantageously, said method further includes the steps of storing a predetermined fuel injection pulse width parameter for a predetermined range of throttle valve angle openings at a predetermined altitude, and measures a prevailing fuel injection pulse width, and calculates the ratio of said actual fuel injection pulse width with said predetermined fuel injection pulse width for determining the prevailing altitude.

According to a feature of said further aspect of this invention there is provided a method for determining an operating parameter of an internal combustion engine comprising the steps of detecting the flow of intake air of an engine and providing an output signal indicative thereof; detecting the number of revolutions of the engine and providing an output signals indicative thereof; detecting the angle of opening of the throttle valve and providing an output signal indicative thereof; computing fuel injection pulse width from said output signals; and applying the signals representative of the number of revolutions of the engine, the angle representative of throttle valve opening, and fuel injection pulse width to an altitude decision means for determining an altitude from said three signals; and correcting at least one of said fuel injection pulse width, said intake air flow rate, and ignition timing of said engine in dependence upon the altitude decided by said altitude decision means.

Advantageously, the fuel injection pulse width is corrected at a time of acceleration in dependence upon signals determinative of water temperature, change of throttle angle per unit of time, and the ratio of the actual fuel injection pulse width with a predetermined fuel injection pulse width at a predetermined altitude.

The altitude is decided from the three signals, that is, the signal from an engine revolution number sensor, the signal from a throttle sensor for detecting the angle of opening of a throttle valve, and the signal computed by an engine parameter computer means from the signals applied thereto from a mass air flow sensor and the revolution number detection sensor.

Using the forementioned signals, the fuel injection rate, the intake air flow and the ignition timing may be corrected.

In order to improve the altitude decision accuracy, moreover, the altitude decision region is preset in terms of the engine revolution number and the throttle opening, and the maximum fuel injection period of the engine is updated in the aforementioned region. The maximum fuel injection period has a reference set at low altitude, for example sea level, and is used to compute the required fuel injection period at other altitudes.

Thus, a predetermined altitude is decided when the fundamental fuel injection pulse width $T_p = kQ_a/N_e$) is computed on the basis of the signal ($Q_a$) from the air flow sensor for the opening of the throttle sensor within a predetermined range and for the engine revolution number ($N_e$) equal to or less than a predetermined value. The actual altitude is then continuously decided in terms of the ratio of the prevailing value of the engine fuel injection pulse width to the maximum value of the updated engine parameter.

From the result thus far described, the individual fixed control constants are corrected with a predetermined correction coefficient.

As a result, it is possible to achieve the optimum control constants for varying altitudes.

BRIEF DESCRIPTION OF THE DRAWINGS

The invention will now be described, by way of example, with reference to the accompanying drawings in which.

In the Figures like reference numerals denote like parts.

DESCRIPTION OF THE PREFERRED EMBODIMENTS

Figure 1:
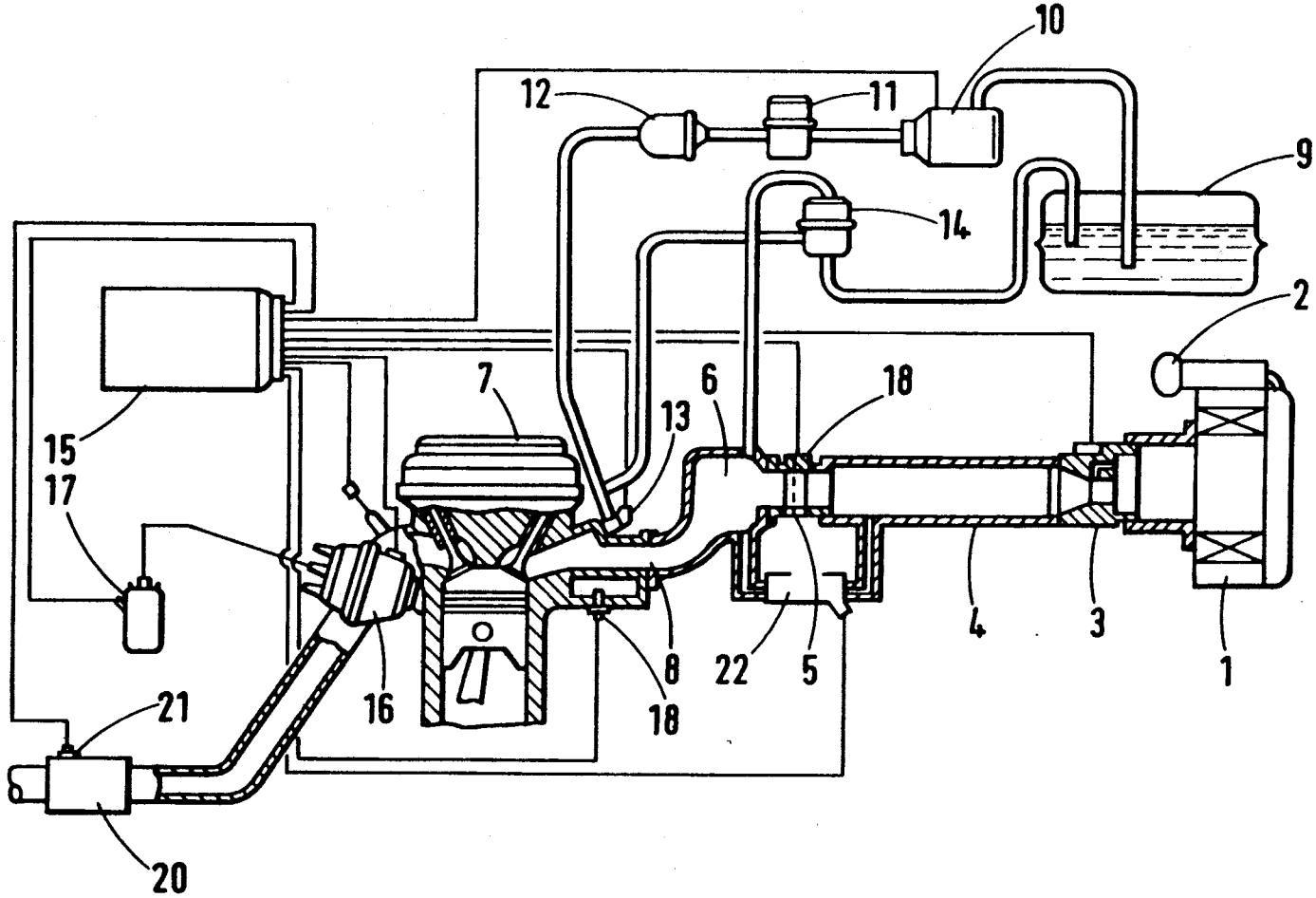
FIG. 1 shows in block schematic form a fuel injection system in which the present invention is used.

An example of an engine system, to which the present invention is applied, is shown in FIG. 1 in which the air to be sucked into the engine 7 is taken from an entrance 2 of an air cleaner 1. The sucked air travels by way of a hot-wire air flow meter 3, for detecting the intake air flow, a duct 4, a throttle valve body 5 equipped therein with a throttle valve for controlling the intake air flow, and an idle speed control (ISC) control valve 22 disposed in a bypass passage of the body 5 to a collector 6. In the collector 6, the intake air is distributed to individual intake pipes 8 connected to the individual cylinders of an engine 7 so that it is introduced into the cylinders.

The fuel, such as gasoline, is sucked from a fuel tank 9 and pressurized by a fuel pump 10 so that it is fed to the fuel system which is composed of a fuel damper Il, a fuel filter 12, a fuel injection valve (or injector) 13 and a fuel pressure regulator 14. Moreover, the fuel is injected, while having its pressure regulated to a constant level by the aforementioned fuel pressure regulator 14, into the intake pipe 8 from the fuel injection valve 13 disposed in the intake pipe 8 of each cylinder.

Figure 3:
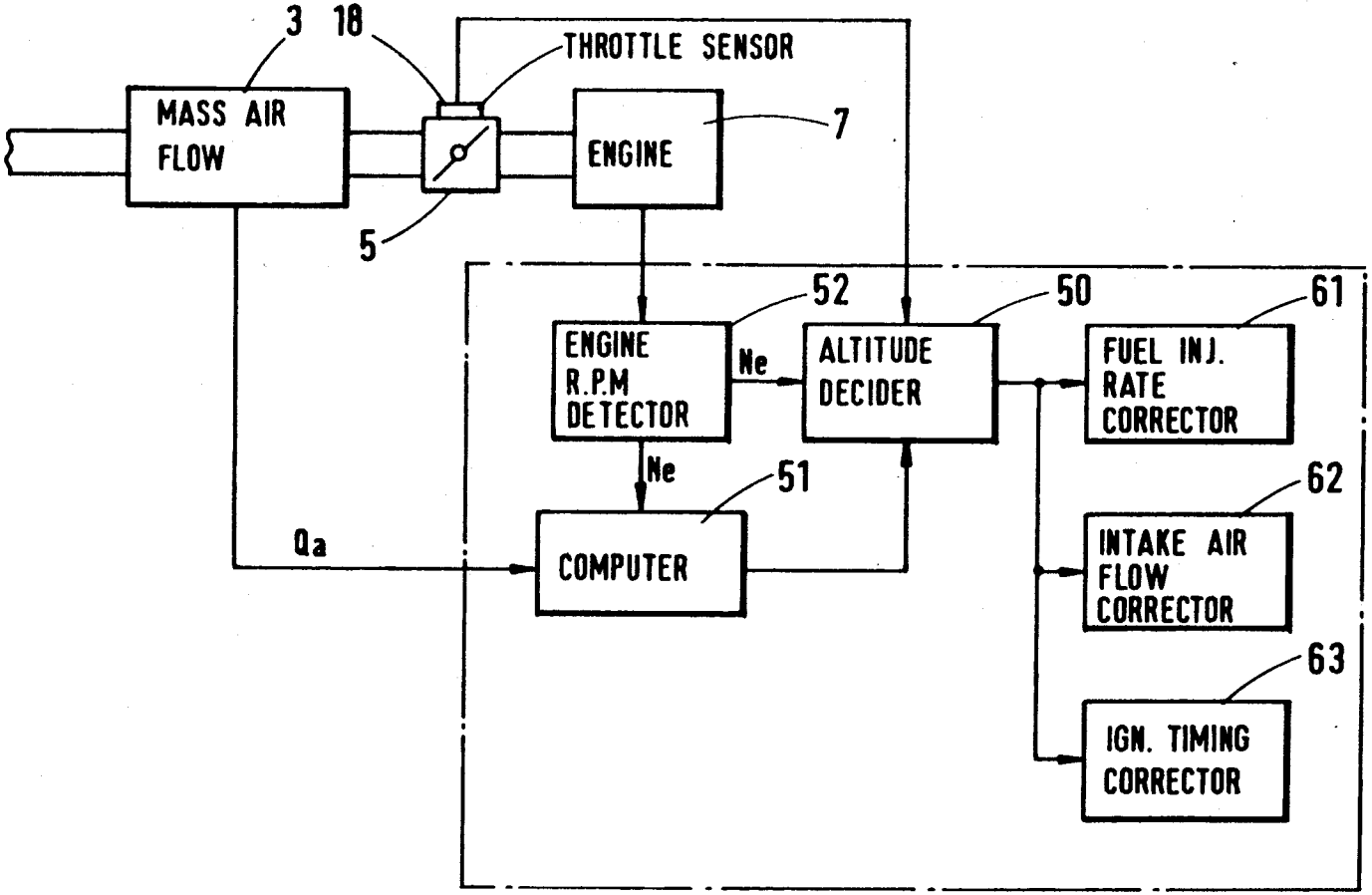
FIG. 3 shows a block schematic diagram of the engine operating parameter control system of the present invention.

A signal indicating the intake air flow is outputted from the aforementioned air flow meter 3 and is inputted to a control unit 15, including a computer 51 (shown in FIG. 3). Moreover, the aforementioned throttle valve body 5 is equipped with a throttle sensor 18 for detecting the angle of opening of the throttle valve 5. The output of the throttle sensor 18 is also inputted to the control unit 15. A distributor 16 has a crank angle sensor 52 (shown in FIG. 3) for outputting a reference angle signal REF indicating the rotational position of the crankshaft and an angle signal POS for detecting the engine rotational speed, for example r.p.m. These signals are also inputted to the control unit 15.

Figure 2:
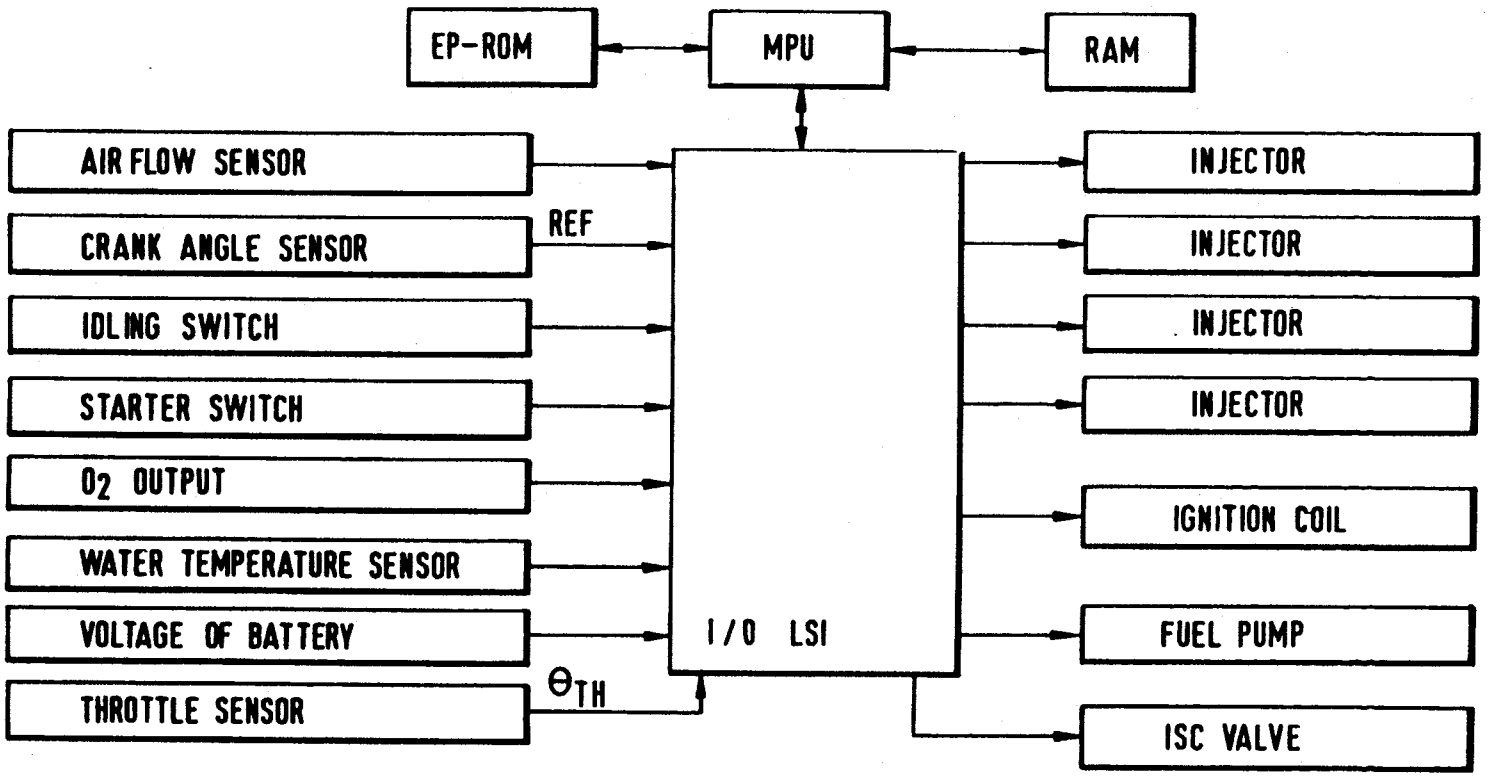
FIG. 2 shows a block schematic diagram of the control system for the engine being controlled.

The major portion of the control unit 15 is shown in FIG. 2. As shown, the signals of an MPU, a ROM, an A/D converter, and various sensors for detecting the running conditions of the engine are fetched as inputs and are subjected to predetermined arithmetic processings. The predetermined ones of these resultant various control signals are outputted to the fuel injection valve 13, an ignition coil 17 and the ISC valve 22 to execute the fuel feed flow control, the ISC control and the ignition timing control.

The system in which the present invention is used is as described below.

The present invention will be described in the following. Referring to FIG. 3, an altitude decider 50 receives the engine r.p.m. ($N_e$), which is computed by the engine revolution number detector 52 from the signal of the crank angle sensor (POS) built in the distributor 16, the signal from the throttle sensor 18, and the engine parameter (i.e., the fundamental (i.e. basic) fuel injection pulse width $T_p=kQ_a/N_e$ in the present invention) which is output from computer 51 from the inputted signal ($Q_a$) of the air flow sensor 3 and the signal ($N_e$) of the aforementioned engine revolution number. The altitude decider outputs signals to a fuel injection rate corrector 61, an intake air flow corrector 62 and an ignition timing corrector 63.

Figure 4:
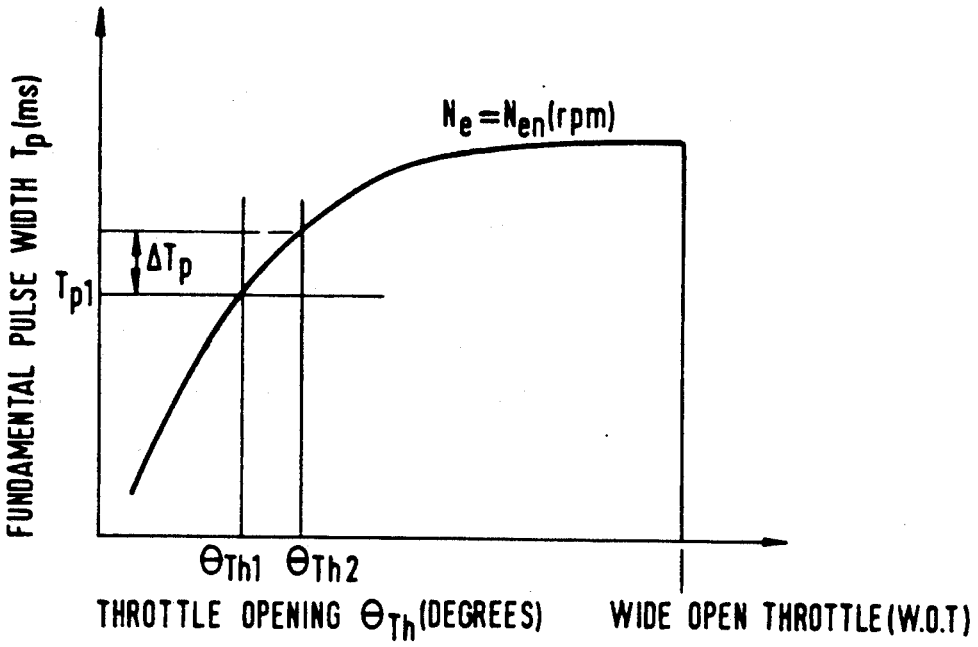
FIG. 4 shows a graph of the fundamental operation of the present invention, FIGS. 5 to 11 each show in graphical form characteristics of the present invention.
Figure 5:
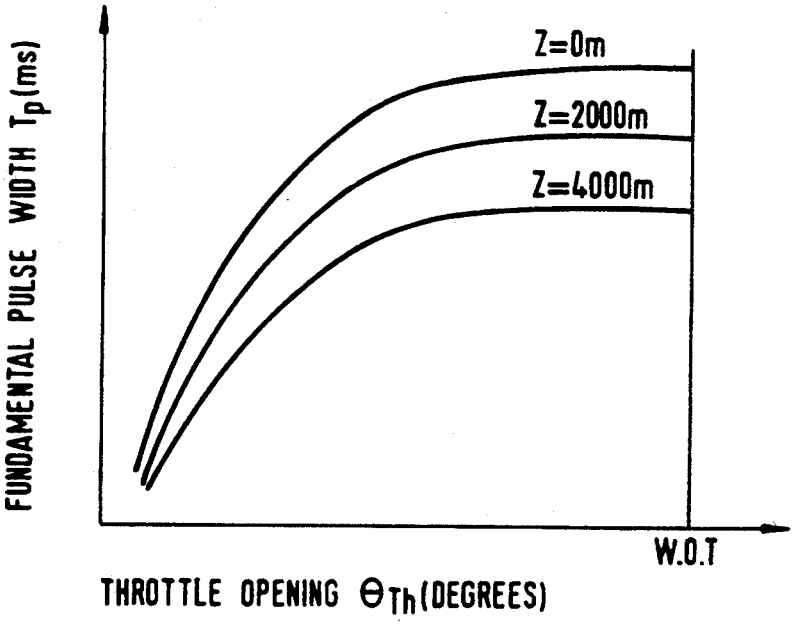

FIG. 4 shows the altitude decision method. For an engine revolution number $N_{en}$, the fundamental pulse with $T_p$ is plotted against the throttle opening $\theta_{Th}$. Hence, the decision region for the throttle opening is set $\theta_{Th1}<\theta_{Th}<\theta_{Th2}$, and the fundamental pulse width $T_{p1}$ is set at sea level, that is Om, to provide a reference for high altitude. The relation of the fundamental pulse width $T_p$ to the throttle opening $\theta_{Th}$ is plotted in FIG. 5 where the fundamental pulse width $T_p$ at the high altitude Z, for example 2000m or 4000m, is smaller than the fundamental pulse width $T_{p1}$, that is set reference at sea level (Om).

As a result, the high altitude can be decided.

Figure 6:
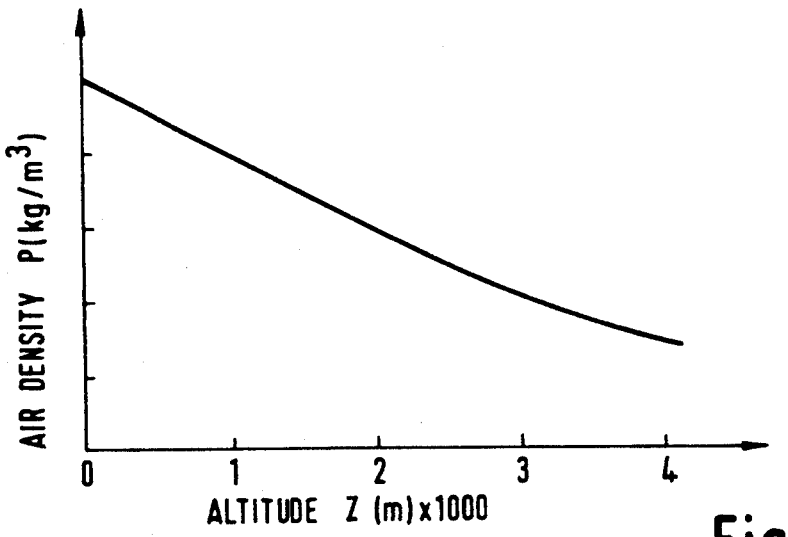
Figure 7:
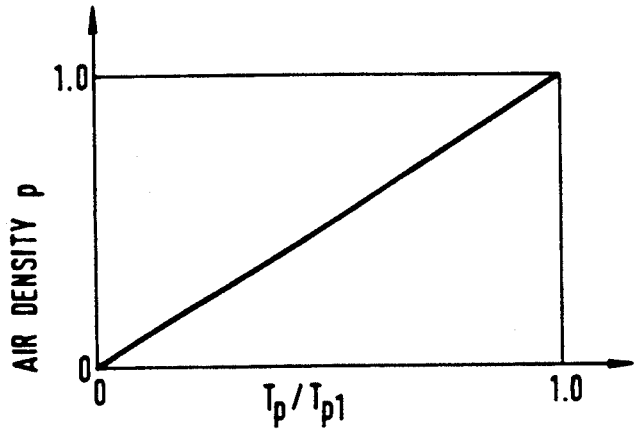

When a desired altitude is to be decided, it is sufficient to set the reference fundamental pulse width $T_p$. When the altitude Z is to be continuously decided, on the other hand, the air density $\rho$ has a relationship to the altitude, as shown in FIG. 6. On the other hand, the ratio of the actual $T_p$ to the reference $T_{p1}$ and the air density $\rho$ are related to each other, as shown in FIG. 7, so that the altitude can be easily detected by computing the ratio $T_p/T_{p1}$.

Figure 16:
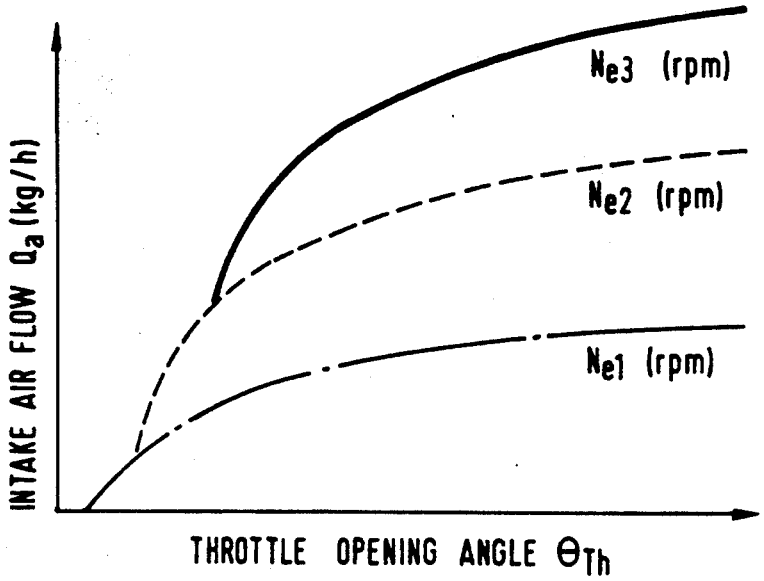
FIGS. 16 and 17 show in graphical form further characteristics of the present invention.
Figure 17:
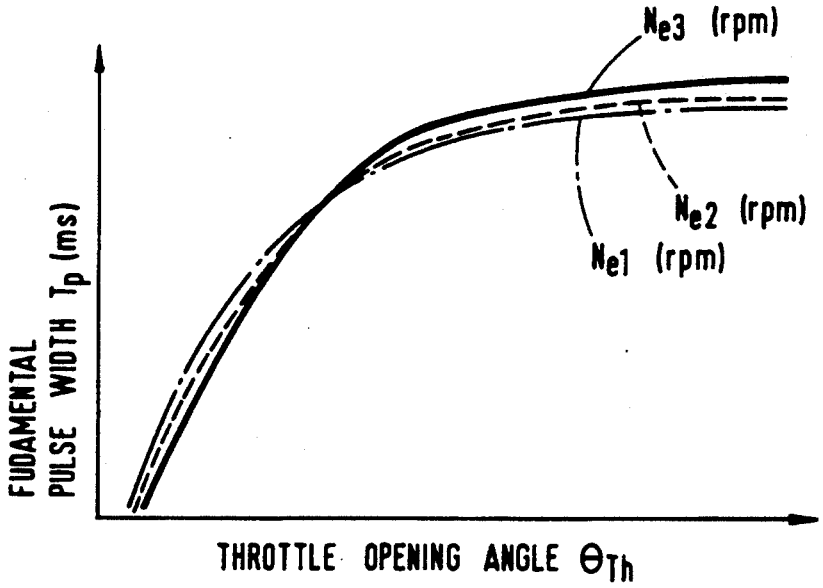

Incidentally, the relationship of the intake air flow to the throttle opening and the relationship of the fundamental pulse width to the throttle opening are plotted in FIGS. 16 and 17, respectively. As apparent from these Figures, the intake air flow will change in dependence upon the engine revolution number even for a steady throttle opening. The beneficial increase is accuracy of the present invention is, thus, demonstrated.

Therefore, the method of correcting the individual control constants from the aforementioned result will be described in the following. First of all, the pulse width (that is TIST) at the start is corrected by the following equation:

$$TIST=TIST\times k_{Qa}\times k_{TST}\times k_S \quad (1),$$

TIST: Pulse width (ms) determined by the cooling water temperature;

$k_{Qa}$: Correction coefficient for the intake air flow, $k_{TST}$: Correction coefficient for the starting time; and $k_s$: Altitude correction coefficient.

Figure 8:
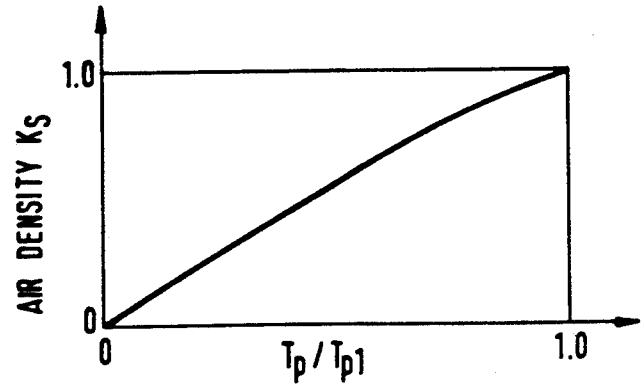

The altitude correction coefficient $k_s$ has characteristics according to the ratio $T_p/T_{p1}$, as are shown in FIG. 8. As a result, the startability obtainable at the high altitude can be similar to that at the low altitude because the pulse width TIST at the start can be optimum for the altitude.

Next, the method of correcting the opening duty of the ISC valve at the start will be described in the following.

The opening duty ISCON of the ISC valve at the start is corrected by the following equation:

$$ISCON=ISCST\times k_{ISC} \quad (2),$$

ISCST: Valve opening duty (%) at the start; and $K_{ISC}$: Altitude correction coefficient.

Figure 9:
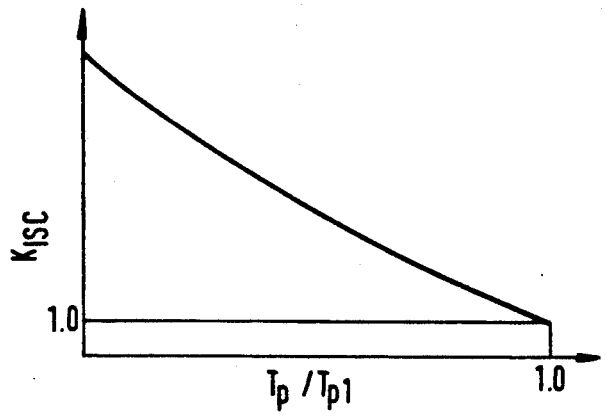

The altitude correction coefficient $K_{ISC}$ has characteristics according to the ratio $T_p/T_{p1}$, as are shown in FIG. 9. As a result, the intake air flow necessary for the engine start at a particular altitude can be attained even at high altitude so that the startability obtainable at high altitude can be similar to that at the low altitude because the opening duty of the ISC valve is increased as the air density $\rho$ drops with an increase in the altitude.

Next, the method of correcting the fuel pulsed injection rate (TINJ) at the time of acceleration will be described in the following. The method of correcting the pulsed injection rate (TINJ) at the time of acceleration is accomplished by the following equation:

$$TINJ=TINJ_t\times k_{INJ} \quad (3),$$

$TINJ_t$: Interrupted injection rate [$f(T_w, \Delta TVO)$] (ms). where $T_w$ is water temperature and $\Delta TVO$ is change of throttle valve angle per unit of time.

Figure 10:
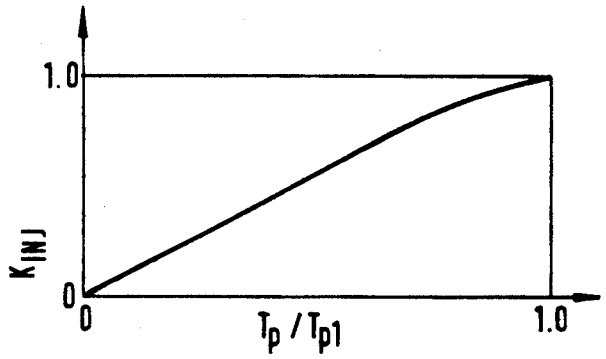

The altitude correction coefficient $k_{INJ}$ has characteristics according to the ratio $T_p/T_{p1}$, as are shown in FIG. 10. As a result, the pulsed injection rate TINJ can be optimized for the altitude. Even at high altitude, the A/F ratio is not enriched excessively so that a drivability similar to that at the low altitude can be achieved.

The method of correcting the ignition timing will be described in the following. This ignition timing is corrected by the following equation:

$$ADV=MAPADV\times k_{ADV} \quad (4),$$

MAPADV: Ignition timing determined according to the engine parameter; and $k_{ADV}$: Altitude correction coefficient.

Figure 11:
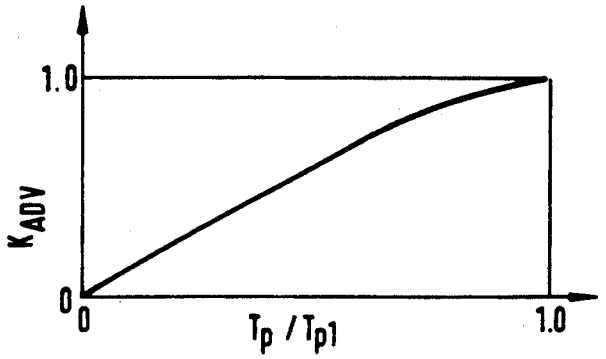

This altitude correction coefficient has characteristics according to the ratio $T_p/T_{p1}$, as are shown in FIG. 11. As a result, the ignition timing ADV can be optimized for the altitude so that the drivability can be similar to that at low altitude without causing knocking at high altitude.

Alternatives of the present invention will now be described with reference to FIGS. 12 and 13. These alternative embodiments are improved over the foregoing embodiment in that the decision region is widened to increase the chance for a correct decision especially where variations in performance of the air flow sensor and throttle sensor occur.

Figure 12:
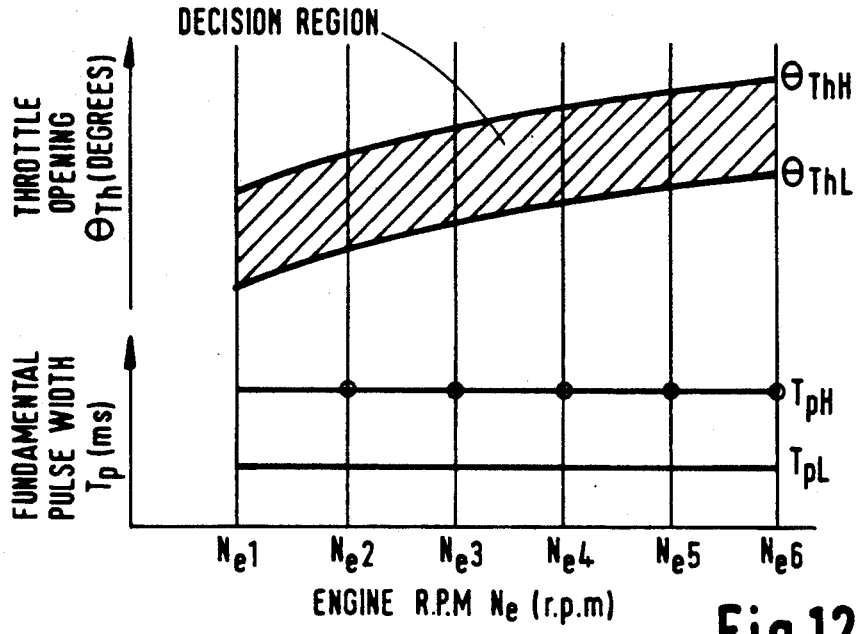
FIG. 12 shows in graphical form alternatives for use in the present invention.
Figure 13:
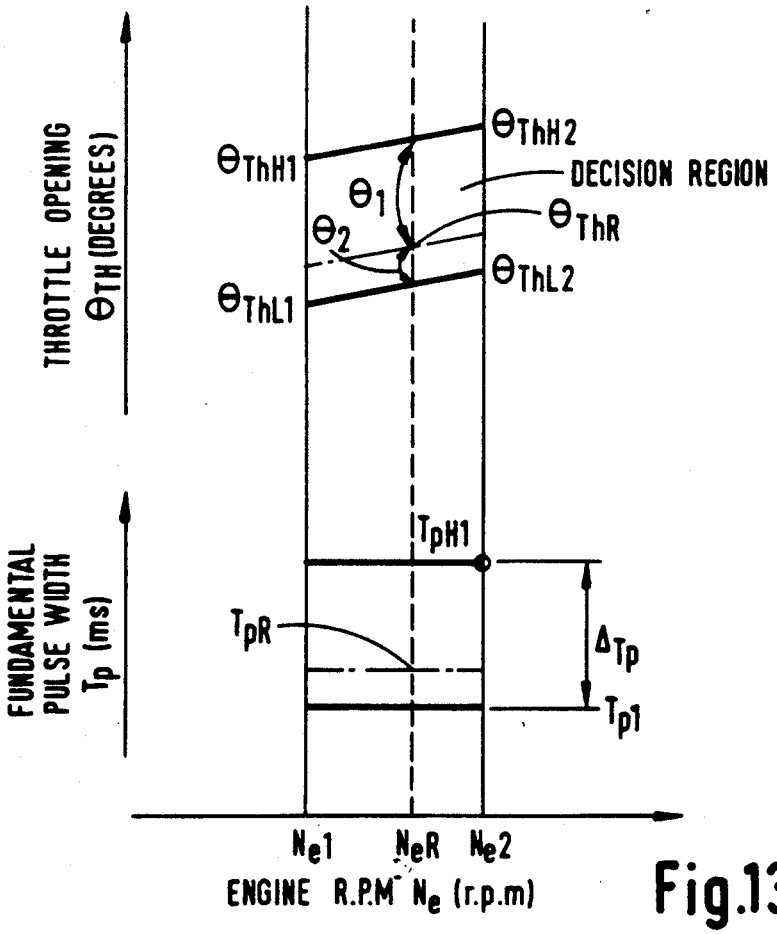
FIG. 13 shows in graphical form yet other alternatives for use in the present invention.

FIG. 12 presents the altitude decision region, by hatched lines, an abscissa of engine revolution number $N_e$ (rpm) and an ordinate of throttle opening $\theta_{Th}$ (degrees). This decision, as defined in the following, may be one but can be set in plurality:

$\Theta_{ThL}<\Theta_{Th}<\Theta_{ThH}$; where the suffix L denotes "low" and H denotes "high", and $N_{en-1}<N_e<N_{en}$.

If the number of decision regions is increased, the decision area between Nen-1 and Nen can be widened to increase the chance for a correct altitude decision and/or the decision area may be divided into smaller areas to thereby improve the accuracy for the altitude decision.

The altitude decision method will be described in detail with reference to FIG. 13. FIG. 13 picks up the region of FIG. 12, in which the engine revolution number is $N_{e1}$ to $N_{e2}$. If the throttle opening region, as indicated at $\Theta_{ThH}$ and $\Theta_{ThL}$, is set, the corresponding individual Values of $T_p$ are determined. This difference is set at $\Delta T_p$, and the width $\Delta T_p$ of the fundamental pulse width $T_p$ corresponding to the difference of $\Theta_{ThH}-\Theta_{ThL}$ is also set. The Width $\Delta T_p$ has to be set for each of the systems because it is different for each system adopting the present invention.

Now will be described the method of computing the reference $T_{p1}$ under this condition for the altitude decision by absorbing the variations of the air flow sensor and the throttle sensor.

First of all, in order to absorb the variations of the air flow sensor and the throttle sensor, the maximum fundamental pulse width $T_p$ in the region under consideration may be computed by study and set to the reference value for the altitude decision. If the prevailing running condition is dictated by a throttle opening $\theta_{ThR}$ and an engine revolution number $N_{eR}$, the fundamental pulse width $T_p$ is then expressed by $T_{pR}$.

As a result, the maximum of the fundamental pulse width $T_p$ in that region can be computed by the following equation:

$$T_{pH1}=T_{pR}+\Theta_1/(\Theta_1+\Theta_2)\times\Delta T_p \text{ (ms)} \quad (5),$$

The maximum $T_{pHn}$ in this region is thus determined. If a new run enters this region, the maximum $T_{pHn}$ is determined again and compared with the previous value $T_{pHn}$ so that the larger value is stored. In other words, an updating is executed if the larger value is computed.

If the value $T_{pHn}$ newly computed in the region is smaller than the stored value $T_{pHn}$, the ratio of the value $T_{pR}$ to the value $T_{pRH}$, which is determined by the following equation (6) from the maximum $T_{pHn}$ stored, is computed to detect the altitude.

$$T_{pRH}=T_{pHn}-\Theta_1/(\Theta_1+\Theta_2)\times\Delta T_p \quad (6).$$

The altitude can be easily detected from the ratio $T_{pR}/T_{pRH}$ in view of the regions of FIGS. 6 and 7, as has been described hereinbefore.

Figure 14:
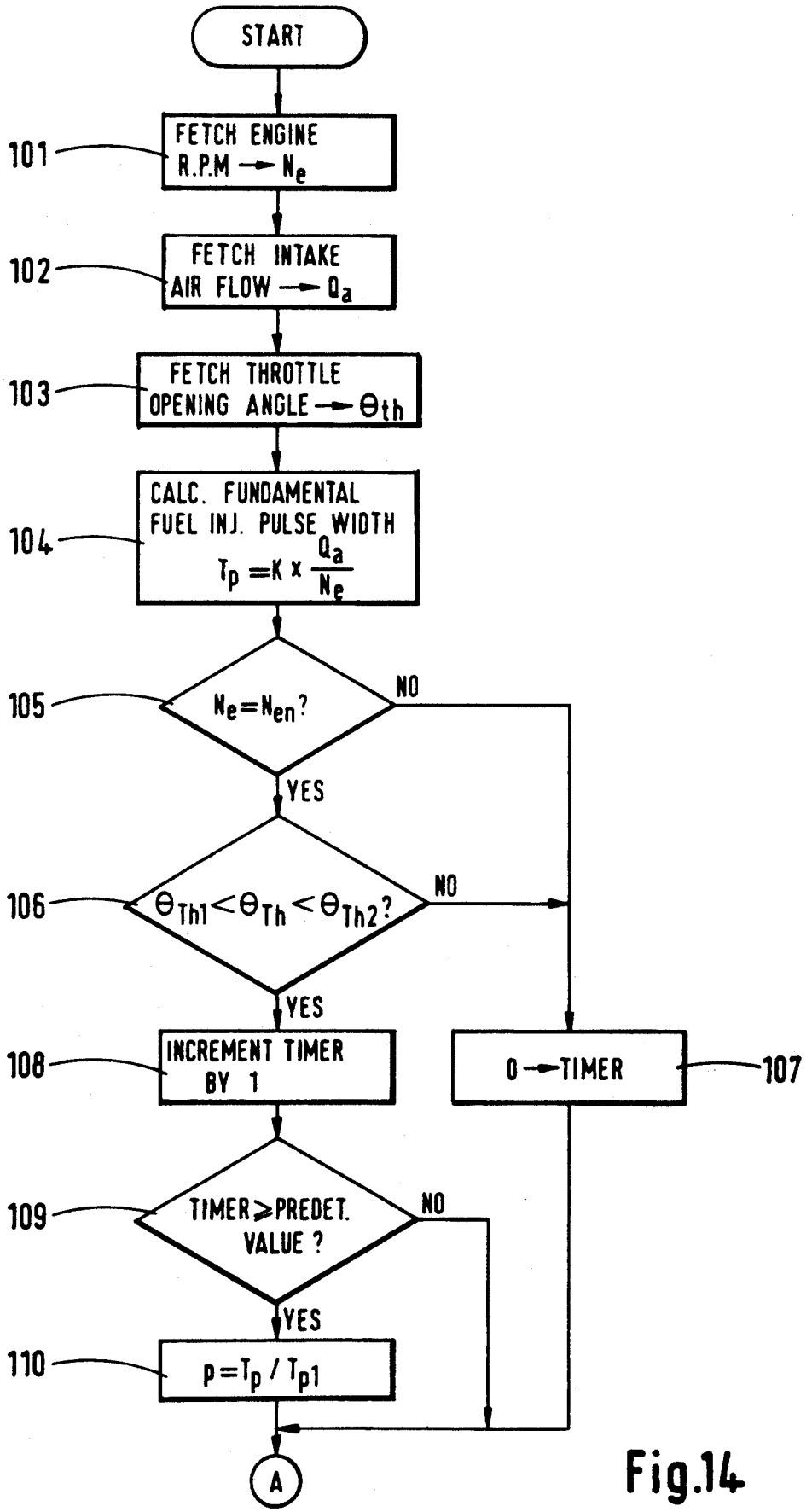
FIGS. 14 and 15 show a flow chart of the present invention.
Figure 15:
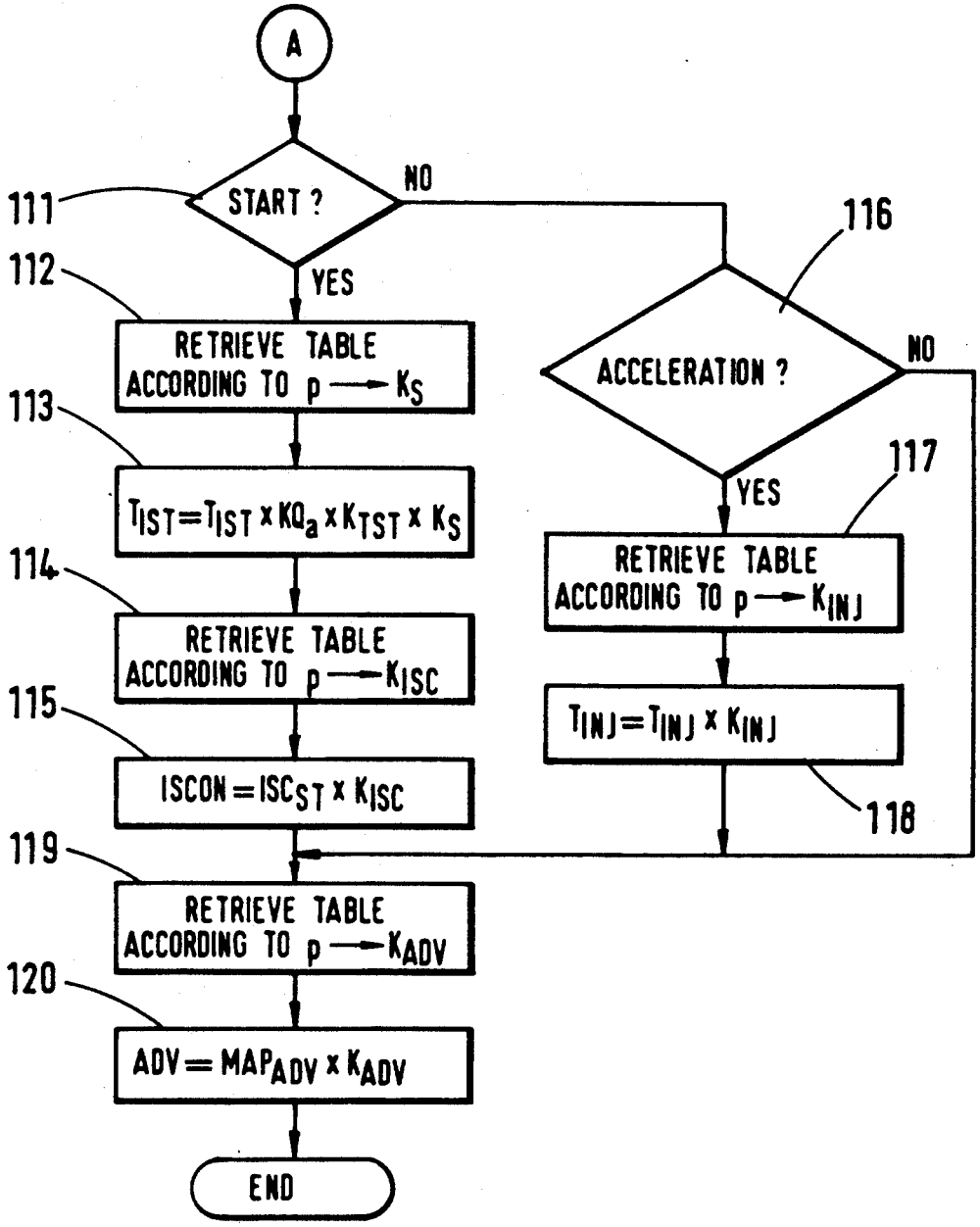

FIGS. 14 and 15 show a flow chart of the operation of the embodiment of the present invention. The program corresponding to this flow chart is repetitively run for predetermined constant time periods (for example, 10 ms). The engine revolution number, the intake air flow and the throttle opening are fetched, respectively, at Steps 101 to 103. At Step 104, the fundamental fuel injection pulse width $T_p$ is computed. Steps 105 to 110 belong to a routine for detecting the altitude. The condition of the engine revolution number is firstly checked at Step 105, and the condition of the throttle opening is checked at Step 106. Unless the conditions therefor are satisfied, the routine advances to Step 107, at which the timer (TIMER) is cleared to advance. If both the conditions of Steps 105 and 106 are satisfied, the routine advances to Step 108, at which the timer is incremented by 1. At Step 109, it is decided whether or not the timer has reached a predetermined value. If NO, the routine advances to step 111 of FIG. 15, but if YES, the routine advances to Step 110, at which $\rho=T_p/T_{p1}$ is computed.

The routine at and after Step 111 presents the method of altitude correction for each control. It is decided at Step 111 whether or not the mode is at the start. If YES, the routine of Steps 112 to 115 is executed At Step 112, the altitude correction coefficient KS of the fuel for the start is determined in accordance with the value $\rho$. At subsequent Step 113, the start pulse width is computed. Next, at Step 114, the start altitude correction coefficient KISC of ISC is retrieved from the table in dependence upon the value $\rho$. At Step 115, the ISCON duty of the ISC is determined. If it is decided at Step 111 that the mode is not the start, it is decided at Step 116 whether or not the mode is acceleration. If YES, the altitude correction coefficient KINJ of the pulsed injection rate for the acceleration is determined at Step 117. At Step 118, the pulsed injection rate is computed. At Steps 119 and 120, the altitude correction for the ignition timing is also executed by retrieving the correction from the table in dependence upon the value $\rho$.

Thus, as will now be understood from the above, in this invention, altitude can be decided from three signals, that is the signal from an engine revolution number sensor, the signal from a throttle sensor for detecting the angle of opening of a throttle valve, and the fundamental fuel injection pulse width computed by an engine parameter compute means from inputted signals from the mass air flow sensor and the revolution number detection sensor.

Moreover, the maximum of the fuel injection pulse width is updated, and this updated value is used as a reference for low altitude so that the altitude is decided from its ratio to the prevailing fuel injection pulse width. As a result, variations of the throttle sensor and the air flow sensor characteristics can be absorbed to decide the altitude highly accurately.

Since the fuel injection rate, the intake air flow and the ignition timing are corrected in accordance with the signal coming from the aforementioned altitude decision means, the optimum values can be attained at the individual altitudes so that the startability and drivability obtainable at the high altitude can be similar to those at low altitude.

It is to be understood that the invention has been described with reference to exemplary embodiments, and modifications may be made without departing from the spirit and scope of the invention as defined in the appended claims.

We claim:

1. An altitude decision system for an internal combustion engine comprising:

an intake air sensor for detecting the flow of intake air of an engine and providing an output signal indicative thereof;

an engine revolution number sensor for detecting the number of revolutions of the engine and providing an output signal indicative thereof;

computer means connected to receive output signals from said intake air flow sensor and said engine revolution sensor and for computing a fundamental fuel injection pulse width signal;

a throttle sensor for detecting the angle of opening of a throttle valve and for providing an output signal indicative thereof; and altitude decision means connected to receive the signals from said revolution number sensor, said throttle sensor and said computer means and on the basis thereof determines an altitude from said three signals.

2. A system according to claim 1 further comprising:

maximum update means for updating the maximum of the fuel injection pulse width signal within a predetermined altitude decision region which is preset in terms of the engine revolution number and the throttle opening;

means for computing the ratio of the prevailing fuel injection pulse width to said maximum; and means for deciding the altitude from said ratio to an altitude representative of the predetermined altitude region.

3. A system according to claim 1 further comprising:

storage means for storing a predetermined fuel injection pulse width parameter ($T_{p1}$) for a predetermined range of throttle valve angle openings ($\theta_{TH}$) at a predetermined altitude, means for measuring a prevailing fuel injection pulse width ($T_p$), and means for calculating the ratio ($T_p/T_{p1}$) of said actual fuel injection pulse width with said predetermined fuel injection pulse width for determining the prevailing altitude.

4. An internal combustion engine operating parameter control system comprising:

an intake air flow sensor for detecting the flow of intake air of an engine and providing an output signal indicative thereof;

an engine revolution number sensor for detecting the number of revolutions of the engine and providing an output signal indicative thereof;

a throttle sensor for detecting the angle of opening of a throttle valve and for providing an output signal indicative thereof;

computer means for computing a fundamental fuel injection pulse width from the signals outputted from said air flow sensor and said engine revolution number sensor;

altitude decision means connected to receive the signals from said revolution number sensor, said throttle sensor and said computer means for determining an altitude from said three signals; and corrector means connected to receive an output from the altitude decision means for correcting at least one of said fuel injection pulse width, said intake air flow rate, and ignition timing of said engine on the basis of altitude.

5. A system according to claim 4 wherein said corrector means for correcting fuel injection pulse width is adapted to vary the fuel injection pulse width at a time of acceleration in dependence upon water temperature, change of the throttle angle per unit of time, and the ratio of an actual fuel injection pulse width ($T_p$) with a predetermined fuel injection pulse width ($T_{p1}$) at predetermined altitude.

6. A method of determining an altitude for an internal combustion engine including the steps of detecting the valve intake area of the engine and providing an output signal indicative thereof;

detecting the number of revolutions of the engine and providing an output signal indicative thereof;

applying said output signals to a computer means for computing a fuel injection pulse width in dependence upon said applied signals;

detecting the angle of opening of a throttle valve and providing an output signal indicative thereof; and applying the signals indicative of the number of engine revolutions, the angle of opening of the throttle valve and the fuel injection pulse width signal to an altitude determining means for determining the altitude from said three signals.

7. A method as claimed in claim 6 further comprising the steps of updating the maximum of the fuel injection pulse width signal within a predetermined altitude decision region which is preset in terms of the engine revolution number and the throttle opening, and computing the ratio of the prevailing fuel injection pulse width to said maximum, and deciding the altitude from said ratio to an altitude representative of the predetermined region.

8. A method as claimed in claim 6 further including the steps of storing a predetermined fuel injection pulse width parameter for a predetermined range of throttle valve angle openings at a predetermined altitude, and measures a prevailing fuel injection pulse width, and calculates the ratio of said actual fuel injection pulse width with said predetermined fuel injection pulse width for determining the prevailing altitude.

9. A method for determining an operating parameter of an internal combustion engine comprising the steps of detecting the flow of intake air of an engine and providing an output signal indicative thereof;

detecting the number of revolutions of the engine and providing an output signals indicative thereof;

detecting the angle of opening of the throttle valve and providing an output signal indicative thereof;

computing fuel injection pulse width from said output signals; and applying the signals representative of the number of revolutions of the engine, the angle representative of throttle valve opening, and fuel injection pulse width to an altitude decision means for determining an altitude from said three signals; and correcting at least one of said fuel injection pulse width, said intake air flow rate, and ignition timing of said engine in dependence upon the altitude decided by said altitude decision means.

10. A method as claimed in claim 9 wherein the fuel injection pulse width is corrected at a time of acceleration in dependence upon signals determinative of water temperature, change of throttle angle per unit of time, and the ratio of the actual fuel injection pulse width with a predetermined fuel injection pulse width at a predetermined altitude.

* * * * *